US010446911B2

(12) United States Patent
Karilainen

(10) Patent No.: US 10,446,911 B2
(45) Date of Patent: Oct. 15, 2019

(54) COVER OF DEVICE ACTING AS ANTENNA OF THE DEVICE

(71) Applicant: Microsoft Technology Licensing, LLC, Redmond, WA (US)

(72) Inventor: Antti Karilainen, Helsinki (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 403 days.

(21) Appl. No.: 15/018,859

(22) Filed: Feb. 8, 2016

(65) Prior Publication Data

US 2017/0229760 A1 Aug. 10, 2017

(51) Int. Cl.

| | |
|---|---|
| ***H01Q 1/24*** | (2006.01) |
| ***H01Q 21/28*** | (2006.01) |
| ***H01Q 3/24*** | (2006.01) |
| ***H01Q 1/22*** | (2006.01) |

(52) U.S. Cl.

CPC ..... *H01Q 1/243* (2013.01); *H01Q 1/2266* (2013.01); *H01Q 3/24* (2013.01); *H01Q 21/28* (2013.01)

(58) Field of Classification Search

CPC ..... H01Q 1/243; H01Q 1/2266; H01Q 3/24; H01Q 21/28

See application file for complete search history.

(56) References Cited

U.S. PATENT DOCUMENTS

| | | | | |
|---|---|---|---|---|
| 6,091,972 | A | 7/2000 | Ogasawara | |
| 7,079,079 | B2 * | 7/2006 | Jo | H01Q 1/243 343/700 MS |
| 7,209,084 | B2 * | 4/2007 | Lindell | H01Q 1/242 343/702 |
| 7,269,393 | B2 * | 9/2007 | Ota | H01Q 1/243 342/352 |

(Continued)

FOREIGN PATENT DOCUMENTS

| | | | |
|---|---|---|---|
| CN | 100456559 | C | 1/2009 |
| CN | 103915690 | A | 7/2014 |

(Continued)

OTHER PUBLICATIONS

"International Search Report and Written Opinion Issued in PCT Application No. PCT/US2017/015705", dated May 30, 2017, 10 Pages.

(Continued)

*Primary Examiner* — Dameon E Levi
*Assistant Examiner* — Ab Salam Alkassim, Jr.

(57) ABSTRACT

A cover of a device acting as an antenna of the device is disclosed. The device comprises a first body and a second body, wherein the first body comprises: a first conductive portion of a first cover of the device configured as an antenna of the device; a second conductive portion of the first cover configured as a ground of the antenna; and a dielectric slot of the first cover; wherein the second body comprises: a first conductive portion of a second cover of the device; a second (Continued)

conductive portion of the second cover; and a dielectric slot in the second cover; wherein a shape of the first and the second conductive portion of the first body and the dielectric slot of the first body aligns with a shape of the first and the second conductive portion of the second body and the dielectric slot of the second body.

20 Claims, 7 Drawing Sheets

(56) References Cited

U.S. PATENT DOCUMENTS

| | | | | |
|---|---|---|---|---|
| 7,417,593 | B1 * | 8/2008 | Hsiao | H01Q 1/243 343/702 |
| 7,876,271 | B2 * | 1/2011 | Nakanishi | H01Q 1/243 343/702 |
| 7,941,116 | B2 | 5/2011 | Man et al. | |
| 8,654,030 | B1 * | 2/2014 | Mercer | H04B 1/3833 343/702 |
| 8,954,122 | B2 | 2/2015 | Wilmhoff et al. | |
| 9,002,268 | B2 | 4/2015 | Desclos et al. | |
| 9,105,986 | B2 * | 8/2015 | Mahanfar | H01Q 21/28 |
| 9,645,608 | B1 * | 5/2017 | Tsai | G06F 1/1616 |
| 9,768,506 | B2 * | 9/2017 | Krogerus | H01C 25/30 |
| 10,075,569 | B2 * | 9/2018 | Kim | H04M 1/026 |
| 2003/0117324 | A1 * | 6/2003 | Iwai | H01Q 1/08 343/702 |
| 2004/0041734 | A1 * | 3/2004 | Shiotsu | G06F 1/1616 343/702 |
| 2004/0063476 | A1 * | 4/2004 | Katagishi | H01Q 1/243 455/575.7 |
| 2004/0227673 | A1 * | 11/2004 | Iwai | H01Q 1/24 343/702 |
| 2008/0106477 | A1 * | 5/2008 | Mashima | H01Q 1/243 343/702 |
| 2009/0231215 | A1 * | 9/2009 | Taura | H01Q 1/243 343/702 |
| 2009/0325528 | A1 | 12/2009 | Yokota et al. | |
| 2010/0285759 | A1 | 11/2010 | Chung et al. | |
| 2012/0139793 | A1 * | 6/2012 | Sharawi | H01Q 1/38 343/700 MS |
| 2014/0051487 | A1 * | 2/2014 | Honma | H04M 1/0214 455/575.3 |
| 2014/0125528 | A1 * | 5/2014 | Tsai | H01Q 1/243 343/702 |
| 2014/0128032 | A1 | 5/2014 | Muthukumar | |
| 2014/0141733 | A1 * | 5/2014 | Wong | H04B 1/3827 455/90.3 |
| 2014/0295919 | A1 * | 10/2014 | Inami | H04M 1/0235 455/566 |
| 2014/0357313 | A1 * | 12/2014 | Mercer | H04B 1/3838 455/552.1 |
| 2015/0281414 | A1 * | 10/2015 | Michino | H04M 1/0216 455/575.3 |
| 2016/0218441 | A1 * | 7/2016 | Tian | H01Q 1/243 |
| 2017/0141820 | A1 * | 5/2017 | Kim | H04B 1/40 |
| 2017/0142241 | A1 * | 5/2017 | Kim | H04M 1/026 |
| 2017/0192478 | A1 * | 7/2017 | Mercer | G06F 1/28 |
| 2017/0264004 | A1 * | 9/2017 | Xiong | H01Q 1/243 |
| 2017/0324150 | A1 * | 11/2017 | Liu | H01Q 1/521 |
| 2017/0351297 | A1 * | 12/2017 | Kim | G06F 1/1616 |
| 2018/0040942 | A1 * | 2/2018 | Lepe | H01Q 1/243 |
| 2019/0103656 | A1 * | 4/2019 | Shi | |

FOREIGN PATENT DOCUMENTS

| | | | |
|---|---|---|---|
| CN | 104244648 | A | 12/2014 |
| EP | 0675562 | A1 | 10/1995 |
| EP | 1033822 | A2 | 9/2000 |
| EP | 1542313 | A1 | 6/2005 |
| EP | 1806907 | A1 | 7/2007 |
| GB | 2517770 | A | 3/2015 |
| WO | 2007026819 | A1 | 3/2007 |
| WO | 2015028710 | A1 | 3/2015 |

OTHER PUBLICATIONS

Li, et al., "Effects of hand phantom and different use patterns on mobile phone antenna radiation performance", In Proceedings of IEEE Antennas and Propagation Society International Symposium, Jul. 5, 2008, 4 pages.

Krogerus, et al., "Effect of the Human Body on Total Radiated Power and the 3-D Radiation Pattern of Mobile Handsets", In Proceedings of IEEE Transactions on Instrumentation and Measurement, vol. 56, No. 6, Dec. 2007, pp. 2375-2385.

"Office Action Issued in European Patent Application No. 17704633.1", dated Jul. 25, 2019, 9 Pages.

"First Office Action and Search Report Issued in Chinese Patent Application No. 201780004800.2", dated Aug. 21, 2019, 15 Pages.

* cited by examiner

COVER OF DEVICE ACTING AS ANTENNA OF THE DEVICE

BACKGROUND

Different types of wireless mobile communication devices may have different antenna assemblies. Limited space in the enclosure of a device, however, may need to be considered while designing such antenna assemblies. An antenna may be compact to occupy relatively small amount of space. A metal cover of the device may be used an antenna element. However, the metal cover being part of the housing of the device may be disturbed by a usage of the device, for example holding the device may increase the undesired electromagnetic coupling and detuning of the antennas.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter.

In an embodiment, a cover of a device acting as an antenna of the device is disclosed. The device comprises a first body and a second body, wherein the bodies are configured to be displaced when using the device, wherein the first body comprises: a first conductive portion of a first cover of the device configured as an antenna of the device; a second conductive portion of the first cover configured as a ground of the antenna; and a dielectric slot in the first cover, which is configured between the first and the second portions; the second body comprises: a first conductive portion of a second cover of the device; a second conductive portion of the second cover; and a dielectric slot in the second cover, which is configured between the first and the second portions; wherein a shape of the first and the second conductive portion of the first body and the dielectric slot of the first body aligns with a shape of the first and the second conductive portion of the second body and the dielectric slot of the second body, when the bodies are one on the other.

An embodiment relates to a mobile device and another embodiment to a method.

Many of the attendant features will be more readily appreciated as they become better understood by reference to the following detailed description considered in connection with the accompanying drawings.

DESCRIPTION OF THE DRAWINGS

The present description will be better understood from the following detailed description read in light of the accompanying drawings, wherein.

Like references are used to designate like parts in the accompanying drawings.

DETAILED DESCRIPTION

The detailed description provided below in connection with the appended drawings is intended as a description of the present embodiments and is not intended to represent the only forms in which the present embodiments may be constructed or utilized. However, the same or equivalent functions and sequences may be accomplished by different embodiments.

Although the present embodiments may be described and illustrated herein as being implemented in a smartphone or a mobile phone, these are only examples of a device having a cover acting as an antenna and not a limitation. The present embodiments are suitable for application in a variety of different types of devices, for example, in tablets, phablets, computers, cameras, game consoles, small laptop computers, smart watches, wearable devices or any other device that has two bodies, wherein a cover of at least one body is configured as an antenna for the device. The term 'computer', 'computing-based device', 'device' or 'mobile device' is used herein to refer to a device with processing capability such that it can execute instructions. Such processing capabilities are incorporated into many different devices.

The phrases "conductive cover portion" and "portion of a conductive cover" are used interchangeably in the following description. According to an embodiment, they may encompass portions of a device cover, the device cover being conductive or at least the cover portion or part of the cover portion being conductive.

Figure 1:
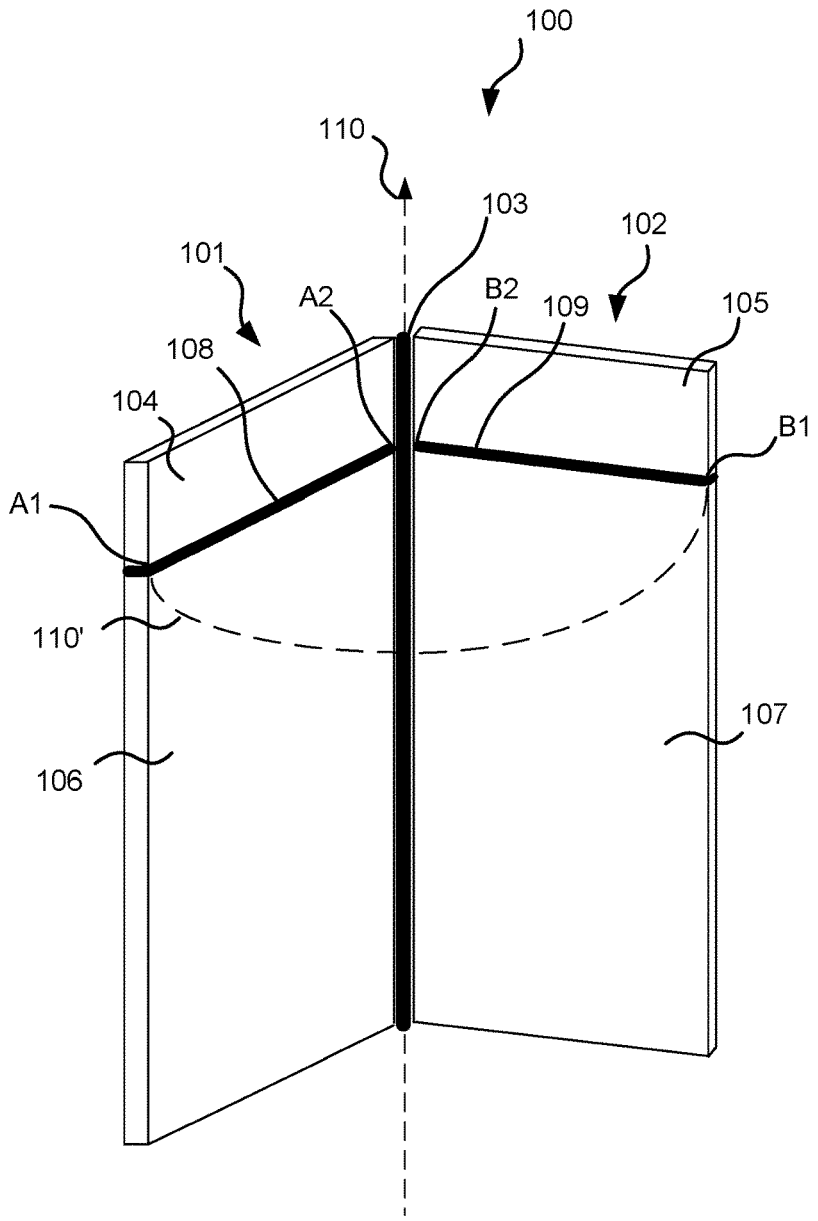
FIG. 1 illustrates a schematic representation of a foldable mobile device having two bodies, each body having a conductive cover acting as an antenna, according to an embodiment.

FIG. 1 is a schematic illustration of a mobile device 100 having two foldable bodies 101, 102. Shapes and design of covers of the bodies 101,102 are symmetric with respect to an axis of rotation 110 through a hinge 103 according to the embodiment. According to an embodiment, a foldable metal-cover wireless communication device may be described, where the antennas are on one or more parts that house the bodies. One of the bodies 101 may have all the radio systems and antennas, and may not be disturbed by another body 102 in any orientation. On the other hand, conductive portions of the bodies 101,102 may be configured to provide additional antenna diversity for enhancing a performance of the antenna. A greater antenna performance, in general, may be obtained due to the additional antenna diversity. For example, in a when the bodies 101,102 are folded and are on top of each other, the antenna may operate using the both bodies 101,102. This may improve the antenna performance. However in an unfolded position, one of the bodies would not necessarily be used for the antenna. This may enable flexibility in the design of the device 100. According to an embodiment, both bodies may operate as an antenna, when the device 100 is in an unfolded position.

The device 100 comprises a first body 101 and a second body 102. Each body may have different components configured to carry out the different operations of the device 100, for example an output, an input, a memory, a processor (not shown in FIG. 1). A joint 103 such as a hinge of FIG. 1 is shown between the bodies 101,102. The trajectory of rotation 110' may be determined by the hinge 103 and the axis of rotation 110. The first body 101 has a first conductive portion 104, a second conductive portion 106 and a dielectric slot 108. The dielectric slot is configured or sandwiched between the portions 104,106. According to an embodiment, the dielectric slot 108 may be also referred to as an antenna stripe. Similarly, the second body 102 has a first conductive portion 105, a second conductive portion 107 and a dielectric slot 109. The dielectric slot 109 is configured or sandwiched between the portions 105,107. The first conductive portions 104,105 are configured as one or more antennas of the device 100. The first conductive portions 104,105, the antenna parts, are separated by the dielectric slots 108,109 from the second conductive portions 106,107. The second conductive portions 106,107 may be configured as an electrical ground, for signal or antenna tuning purposes, for the first conductive portions 104,105 respectively. The dielectric slots 108 and 109 disconnect the portions 104 and 106, 105 and 107, respectively. Signal fed may be connected to the first conductive portions 104,105, and/or to the second conductive portions 106,107. The first conductive portions 104,105 may comprise one or more antennas for one or more radio systems. The second conductive portions 106,107 may house most of the components of the device 100. The first conductive portions 104,105 may also house components. The second conductive portions 106,107 can be connected to each other at one or more edges, faces, points, etc.

According to an embodiment, the conductive portions may act as covers of the device 100. They may be metallic, for example substantially fully metallic, and only openings, such as the slots 108,109, for example 1-2 mm wide plastic stripes, may be dielectric. According to another embodiment, the slots 108,109 may be 2-4 mm wide, and clearly narrower than the width of the first conductive portions 104,105. According to yet another embodiment, both the slot 108,109 and the conductive portions 104,105 and 106,107 are narrow. For example the conductive portion may be as narrow as the slot. There may be other kinds of slot implementations that are used for the antennas and the slots 108,109 and FIG. 1 and the numerical values discussed herein are merely one possible embodiment.

Points A1 and B1, and A2 and B2 align when the device 100 is folded. According to an embodiment, the bodies 101,102 are also on top of each other when the device 100 is folded or in the folded position. According to an embodiment, when bodies 101,102 are on top of each other they may be contacting each other, according to an embodiment at least partially. According to an embodiment, when bodies 101,102 are on top of each other they may be fully contacting each other. According to an embodiment, when the bodies 101,102 are on top of each other, they may not be contacting each other but vertically lie in parallel to each other so that their direction is substantially the same. When the device 100 is folded, the shape of the conductive portions and the slots of different bodies align in such a way that the antennas may continue to operate. For example, the change in the thickness of the device 100, when being folded, does not detune the antennas appreciably, but drastically different radiator length might and this may be avoided by the embodiment. The antenna performance may be improved by additional antenna diversity given by the aligned bodies 101,102. On the other hand, when the device 100 is unfolded, the antennas in different bodies are separated or modified in such a way that the antennas still work the way specified. By unfolding the device 100, the conductive portions may be configured as additional antenna for antenna diversity. Consequently, an antenna of the first body 101 enhances the antenna of the second body 102. Furthermore when the device 100 is unfolded, conductive portions can be located away from the user effects, such as hand absorption, thereby the antennas may not be disturbed by the hand and fingers.

According to an embodiment, the device 100 may be thin and foldable and the antenna solution may mitigate most of the difficulties relating to the problem of detuning the antennas by a touch of a hand or finger. Furthermore, the embodiment may mitigate the effect that a hand or a finger of a user may potentially absorb the power intended for wireless communications.

Referring to an embodiment, the covers may house a support structure to which various electronic and electrical components (not illustrated in FIG. 1) of a mobile device 100 are attached. These components may be, for example, camera modules, microphones, LEDs, sensors, displays, outputs, etc. which are exposed to the exterior through openings or windows in the conductive cover portions 104,105,106,107. The components may also be, for example, the processor, GPU, digital signal processor, USB port, connectivity port, charging port etc., which are either hidden or partially exposed to the exterior through a conductive cover portions or sides of the device 100.

Referring to an embodiment illustrated in FIG. 1, antennas and antenna feeds may electromagnetically couple with slots 108 and 109 respectively. This configuration may comprise slot antennas. Slot antennas may use a slot in a surface as a radiating and/or receiving element of an antenna. In an embodiment, antenna feeds for slots 108 and 109 may be configured for the same frequency band. In another embodiment, antenna feeds for slots 108 and 109 may be configured for different frequency bands. According to an embodiment, at least one of feeds and its corresponding slot 108, 109, and conductive portion 104,105,106,107 may be configured for a frequency range or a part thereof selected from at least one of: 698-960 MHz, 1.71 to 2.17 GHz, and 2.3 to 2.7 GHz. These frequency ranges may be called LTE Low Band (698-960 MHz), LTE Medium Band (1.71 to 2.17 GHz) and LTE High Band (2.3 to 2.7 GHz) respectively in the relevant literature. According to an embodiment, Long Term Evolution standard (LTE) may be supported. In an embodiment, at least one of antenna feeds and its corresponding slot 108, 109, and conductive portion 104,105,106,107 may be configured for frequencies in frequency ranges designated for global positioning system, GPS, global navigation satellite system, GLONASS, Chinese satellite navigation system, BeiDou, global navigation satellite system, Galileo, Wi-Fi, Wireless LAN, worldwide interoperability for microwave access, WiMAX, or any of the various non-cellular wireless systems, etc. In an embodiment, a device 100 may include a switch (not illustrated in FIG. 1) between the two antenna feeds, which may allow the device 100 to dynamically use either one of the antenna feeds.

According to an embodiment, the conductive covers 104,105,106,107 may be configured to implement the antenna diversity. Antenna diversity schemes may improve performance and reliability of wireless links by employing multiple co-located antennas. In an embodiment, device 100 may include more than two cover portions and corresponding slot and antenna feed pairs and enable high order diversity antenna feeds. In an embodiment, antenna feeds may be configured for receive (Rx) diversity. In another embodiment, antenna feeds may be configured for transmit (Tx) diversity. In an embodiment, antenna feeds and slots 108, 109 may be configured for Multiple Input Multiple Output (MIMO) operation. MIMO operation in radio communication may improve capacity of a wireless link. MIMO may require multiple antennas in some cases, for example, in single user MIMO. The terms used herein are standard in academia or industry and are used for illustration purposes only, and instead of standardized terms and functions other embodiments may be applicable having similar features and/or functions.

Figure 2:
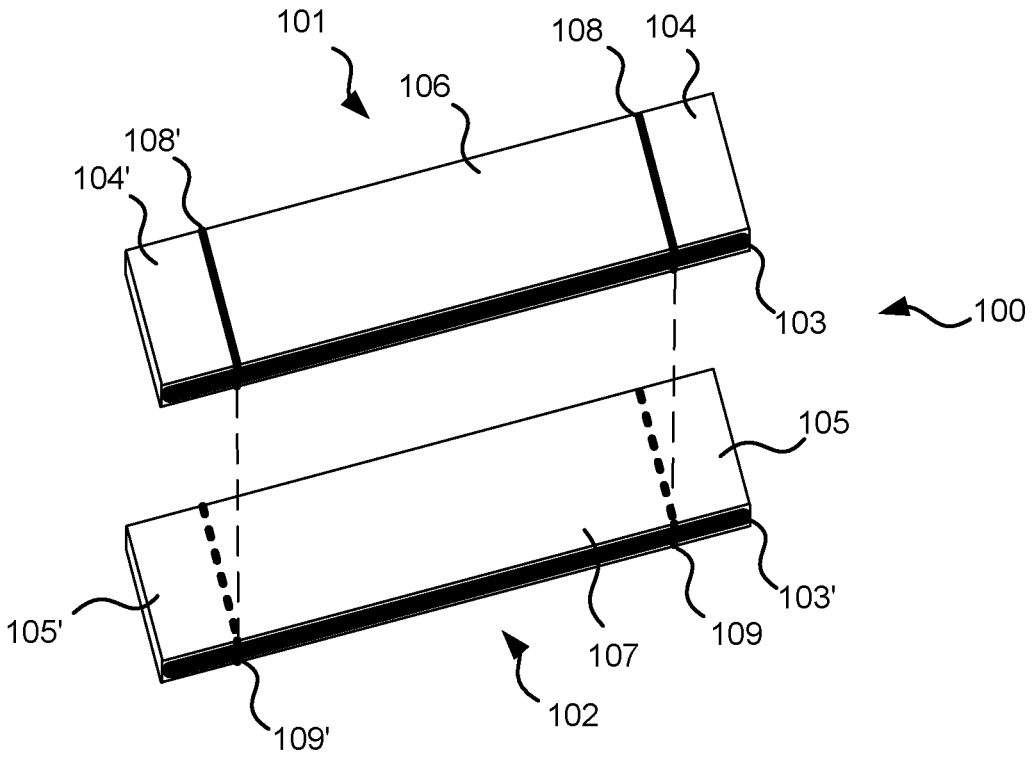
FIG. 2 illustrates a schematic representation of a mobile device having two detachable bodies, each body having with a conductive cover acting as an antenna, according to an embodiment.

FIG. 2 illustrates a schematic representation of a mobile device 100, which may be similar to the embodiment of FIG. 1. The device 100 comprises two detachable bodies 101,102. Each body 101,102 comprises two conductive cover portions 104,105 and 104', 105' acting as antennas according to an embodiment.

The embodiment of FIG. 2 comprises a detachable joint 103'. Bodies 101,102 may be attached and detached with respect to each other by the joint 103'. The join 103' may also act as a hinge. However another embodiment may not have a hinge element and the hinge. The bodies 101,102 may be stacked on top of each other, when the joint 103' is either attached or detached. When attached, the conductive portions 104,104', 105,105' may act jointly for enhancing the antennas. The joint 103' may have connection lines for connecting the portions. A dielectric slot 109,109' is shown by dashed lines for illustrating that the cover and the slot is situated at a back of the body 102. The first body 101 comprises two portions 104 and 104'. Consequently, two regions corresponding to the portions 104,104' are configured as the antenna. Similarly, the second body 102 comprises two portions 105,105', which are configured as the antenna. The portions may be of the same size or have different sizes. The shapes of the covers of the bodies 101,102 align when the bodies 101,102 are on top of each other.

Figure 3:
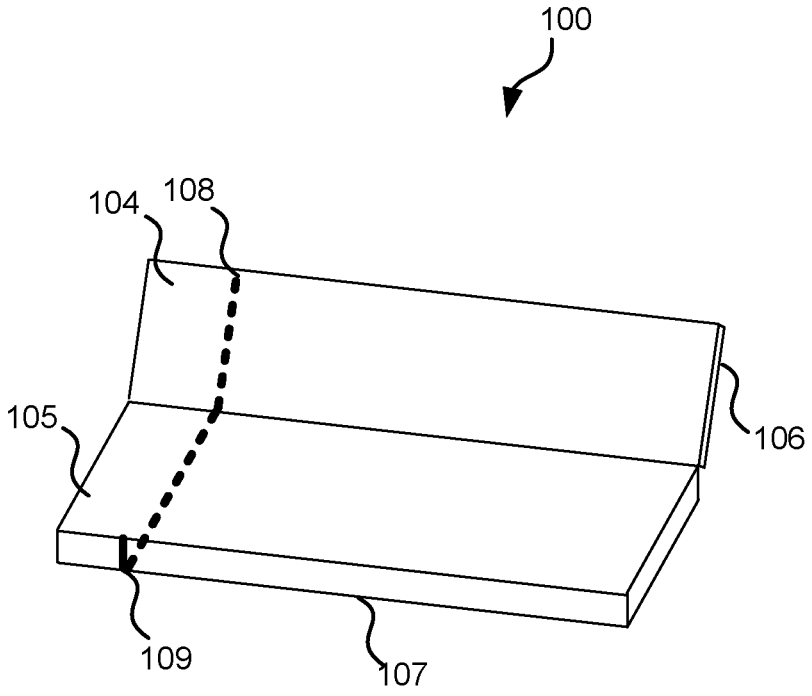
FIG. 3 illustrates a schematic representation of a foldable mobile device being in an unfolded position, wherein the antenna of one body supports the antenna of the other body, according to an embodiment.

FIG. 3 illustrates a schematic representation of a foldable mobile device 100 being in an unfolded, opened position, wherein the antenna of one of the body 101,102 supports the antenna of the other body 101,102 according to an embodiment. When the device 100 is unfolded, the conductive portions 104,105 are configured as the antenna of the device 100 so as to enhance the antenna performance, for example the antenna diversity. This may improve the use of the device 100, because more powerful wireless communications may be required when the device 100 is in the unfolded position.

Figure 4:
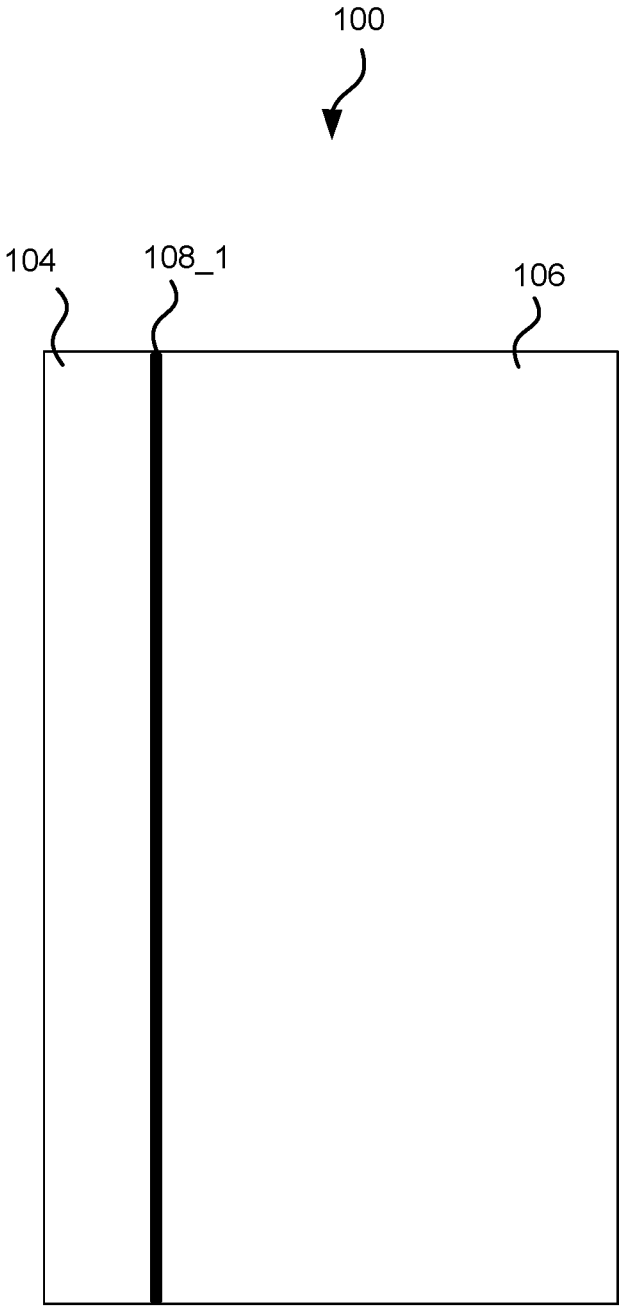
FIG. 4 illustrates a schematic representation of a cover of a mobile device having a vertical dielectric slot according to an embodiment.

FIG. 4 illustrates a schematic representation of a cover of one of the bodies of the mobile device 100 having a vertical dielectric slot 108 according to an embodiment. The dielectric slot 108_1 may be vertical with respect to the design of the device 100. Consequently, it may be parallel to the direction of the joint 103 (not shown in FIG. 4) and the axis of rotation (not shown in FIG. 4). A shape of the first conductive portion 104 and a shape of the second conductive portion 105 are designed accordingly based on the vertical dielectric slot 108_1.

Figure 5:
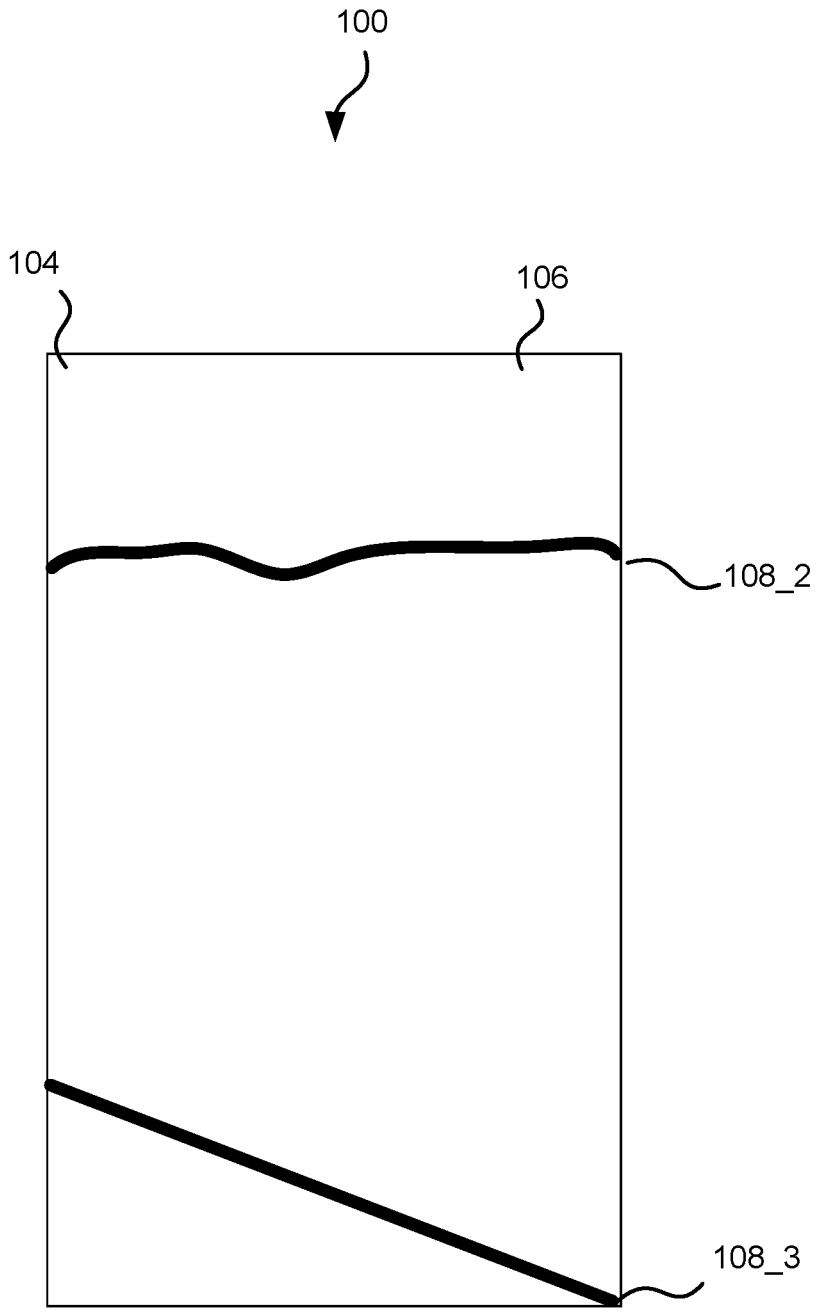
FIG. 5 illustrates a schematic representation of a cover of a mobile device having a freeform line slot and an oblique slot according to an embodiment.

FIG. 5 illustrates a schematic representation of a cover of one of the bodies of the mobile device 100 having a freeform line slot 108_2 and an oblique slot 108_3 according to an embodiment. The shape and design of the dielectric slot 108 may vary. For example, the intended use and other design and engineering aspects of the device 100 may affect the shape of the slot 108. For example, the slot 108 need not be horizontal or vertical but an oblique slot design may be used. For another example, the slot 108 need not be straight but a freeform line design may be used.

Figure 6:
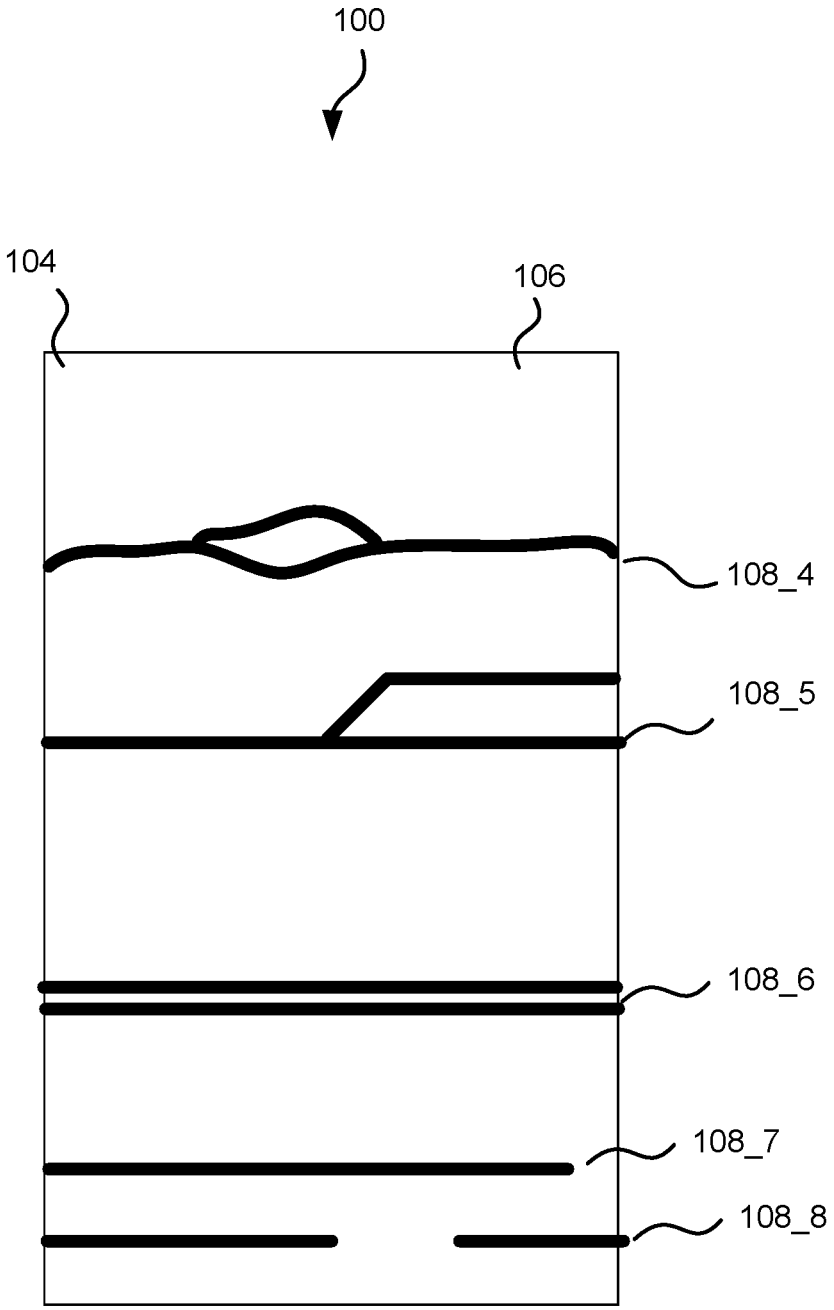
FIG. 6 illustrates a schematic representation of a cover of a mobile device having a freeform line slot and dual slots according to an embodiment.

FIG. 6 illustrates a schematic representation of a cover of one of the bodies of the device 100. The embodiment of FIG. 6 comprises an island of conductive material surrounded by a slot 108_4. This may conform to the design of the cover. The cover comprises a branching slot 108_5, wherein one of the ends of the slot is divided into two slots and a portion is between the two divided slots. Furthermore, the cover comprises two (or more) slots close or in proximity to each other 108_6. There may be narrow portion of the conductive material between the slots 108_6. According to an embodiment, the dielectric slot 108 may not completely split the cover in two separate parts. The slot may be illustrated by references 108_7 and 108_8 in FIG. 6, wherein the slot 108_7,108_8 does not extend from an edge of the cover to the opposite edge. Furthermore, it should be noted that the slot 108 may be at least partially invisible to the user of the device 100.

It should be noted that FIGS. 1 to 5 are for illustrative purposes only and any dimensions or relative sizes so illustrated are for representative purposes only and should not be construed as limitations. Further it should be noted that some or all the components illustrated in FIGS. 1 to 5 may or may not be to scale.

Figure 7:
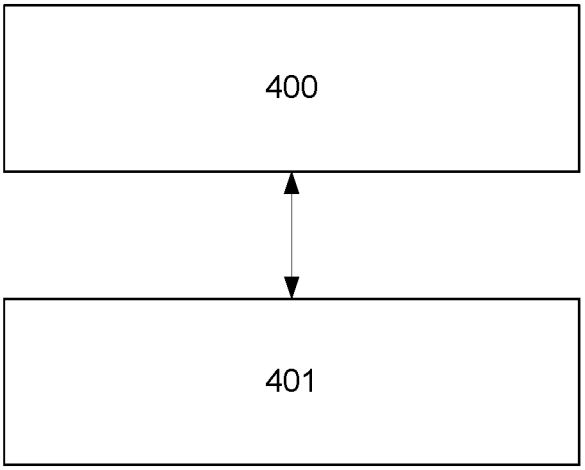
FIG. 7 illustrates a process of operating the device, in accordance with an illustrative embodiment.

An embodiment of a method for operating the device 100 is illustrated in FIG. 7.

According to an embodiment, a method comprises the following operations. In operation 400, a first and a second body 101,102 of a device 100 is attached to each other to a folded position so that a shape of a first and a second conductive portion 104,106 of the first body 101 and the dielectric slot 108 of the first body aligns with a shape of the first and the second conductive portion 105,107 of the second body and the dielectric slot 109 of the second body 102. In the operation 400, the first conductive portions 104,105 do not detune the antenna, when the device 100 is in the folded position. The antenna or multiple antennas of the device continue to operate normally. In operation 401, when the bodies 101,102 are attached to each other, the device 100 is unfolded to an unfold position so that the first conductive portion 104 of the first body 101 and the first conductive portion 105 of the second body 102 are configured for additional antenna diversity for the antenna. This may improve the wireless communication and antenna operation. The device 100 may be manufactured by attaching the bodies 101,102 to each other. When the bodies 101,102 are attached to each other they may be folded to the folded position and unfolded to the unfolded position. The device 100 may be operated between the operations 400 and 401.

Any range or device value given herein may be extended or altered without losing the effect sought. Also any example may be combined to another example unless explicitly disallowed.

Although the subject matter has been described in language specific to structural features and/or acts, it is to be understood that the subject matter defined in the appended claims is not necessarily limited to the specific features or acts described above. Rather, the specific features and acts described above are disclosed as embodiments of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the embodiments described above may be combined with aspects of any of the other embodiments described to form further embodiments without losing the effect sought, or without extending beyond the disclosure.

The term 'comprising' is used herein to mean including the method, blocks or elements identified, but that such blocks or elements do not comprise an exclusive list and a method or apparatus may contain additional blocks or elements.

According to an embodiment, a device comprises: a first body and a second body, wherein the bodies are configured to be displaceable when using the device; wherein the first body comprises: a first conductive portion of a cover of the device configured as an antenna of the device; a second conductive portion of the cover configured as a ground of the antenna; and a dielectric slot in the cover, which is configured between the first and the second portions; wherein the second body comprises: a first conductive portion of a second cover of the device; a second conductive portion of the second cover; and a dielectric slot in the second cover, which is configured between the first and the second portions; wherein a shape of the first and the second conductive portion of the first body and the dielectric slot of the first body aligns with a shape of the first and the second conductive portion of the second body and the dielectric slot of the second body, when the bodies are on one another.

Alternatively or in addition to the above, the first conductive portion of the second body is configured for additional antenna diversity for the antenna and the second conductive portion of the second body is configured for the additional antenna diversity as additional ground.

Alternatively or in addition to the above, the shapes are symmetrical.

Alternatively or in addition to the above, the shapes are identical.

Alternatively or in addition to the above, the device is foldable so that the first and the second bodies are attached by a hinge.

Alternatively or in addition to the above, the shapes are symmetrical with respect to an axis of rotation of the hinge.

Alternatively or in addition to the above, when the bodies are in a folded position so that the bodies are on one another both bodies are configured as the antenna, and when the bodies are in an unfolded position the first body is configured as the antenna.

Alternatively or in addition to the above, when the bodies are in a folded position so that the bodies are on one another both bodies are configures as the antenna, and when the bodies are in an unfolded position both bodies are configured as the antenna.

Alternatively or in addition to the above, the first and the second bodies are detachable.

Alternatively or in addition to the above, each body further includes a third conductive portion configured as the antenna and a second dielectric slot configured between the third conductive portion and the second conductive portion.

Alternatively or in addition to the above, a width of the dielectric slot is substantially smaller than a width of the first conductive portion.

Alternatively or in addition to the above, the first conductive portion is configured as multiple antennas of the device.

Alternatively or in addition to the above, the first and the second conductive portions comprise metal.

Alternatively or in addition to the above, the dielectric slot is configured as one of the following: horizontal, vertical, a freeform line, an oblique line, branching, and dual slots.

Alternatively or in addition to the above, an edge of the first conductive portion of the first body and an edge of the first conductive portion of the second body are located at a distance from each other.

Alternatively or in addition to the above, the distance is larger when the device is in an unfolded position than when the device is in a folded position.

According to an embodiment a mobile device comprises: a first body and a second body, wherein the bodies are configured to be displaceable with respect to each other when using the mobile device, wherein each body comprises: a first conductive portion of a cover of the mobile device configured as an antenna of the device; a second conductive portion of the cover configured as a ground of the antenna; a dielectric slot in the cover, which is configured between the first and the second portions; wherein a design of the first and the second conductive portion of the first body and the dielectric slot of the first body aligns with a design of the first and the second conductive portion of the second body and the dielectric slot of the second body, when the bodies are on one another.

Alternatively or in addition to the above, the first conductive portion of the second body is configured for antenna diversity for the antenna.

According to an embodiment, a method comprises: attaching a first and a second body of a device to each other to a folded position so that a shape of a first and a second conductive portion of the first body and the dielectric slot of the first body aligns with a shape of the first and the second conductive portion of the second body and the dielectric slot of the second body, wherein the first body comprises: the first conductive portion of a cover of the device configured as an antenna of the device; a second conductive portion of the cover configured as a ground of the antenna; and a dielectric slot of the cover, which is configured between the first and the second portions; wherein the second body comprises: a first conductive portion of the cover of the device; a second conductive portion of the cover; and a dielectric slot of the cover, which is configured between the first and the second portions; and maintaining the attachment, when the device is unfolded to an unfold position, wherein the device is unfoldable to the unfold position so that the first conductive portion of the first body and the first conductive portion of the second body are at a distance from each other.

Alternatively or in addition to the above, the first conductive portion of the first body and the first conductive portion of the second body are configured for additional antenna diversity of the antenna.

The embodiments illustrated and described herein as well as embodiments not specifically described herein but within the scope of aspects of the disclosure constitute exemplary means for displacing bodies of the device and means for bodies acting as an antenna of the device. For example, the elements illustrated in FIG. 1 to FIG. 6 constitute exemplary means for displacing conductive portion, exemplary means for configuring antenna of the device, exemplary means for configuring a ground of the antenna, exemplary means for isolating conductive portions, and exemplary means for aligning a shape of the bodies.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A device, comprising:

a first body and a second body, wherein the bodies are configured to be displaceable when using the device;

wherein the first body comprises:

a first conductive portion of a cover of the device configured as an antenna of the device;

a second conductive portion of the cover configured as a ground of the antenna; and a dielectric slot in the cover, which is configured between the first and the second conductive portions and extends along at least a portion of a length of the cover from an edge to an opposite edge of the cover to divide the first and second conductive portions of the first body;

wherein the second body comprises:

a first conductive portion of a second cover of the device;

a second conductive portion of the second cover; and a dielectric slot in the second cover, which is configured between the first and the second conductive portions, the dielectric slot of the cover and the second cover extending across an entire length of a face of the cover and the second cover, respectively, from an edge to an opposite edge of the first cover and the second cover, and are configured to completely divide and electrically disconnect respective first and second conductive portions of each of the cover and the second cover;

wherein a shape of the first and the second conductive portion of the first body and the dielectric slot of the first body aligns identically with a shape of the first and the second conductive portion of the second body and the dielectric slot of the second body when the bodies are on one another, the first and second conductive portions operable as antenna elements when the first and second bodies are on one another and when the first and second bodies are separated.

2. The device of claim 1, wherein the first conductive portion of the second body is configured for additional antenna diversity for the antenna and the second conductive portion of the second body is configured for the additional antenna diversity as additional ground.

3. The device of claim 1, wherein the shapes are symmetrical.

4. The device of claim 1, wherein the shapes are identical and the dielectric slot of the cover and the second cover are sandwiched between respective first and second conductive portions of the cover and the second cover.

5. The device of claim 1, wherein the device is foldable so that the first and the second bodies are attached by a hinge.

6. The device of claim 5, wherein the shapes are symmetrical with respect to an axis of rotation of the hinge.

7. The device of claim 5, wherein when the bodies are in a folded position so that the bodies are on one another, both bodies are configured as the antenna, and when the bodies are in an unfolded position the first body is configured as the antenna.

8. The device of claim 5, wherein when the bodies are in a folded position so that the bodies are on one another, both bodies are configured as the antenna, and when the bodies are in an unfolded position both bodies are configured as the antenna.

9. The device of claim 1, wherein the first and the second bodies are detachable.

10. The device of claim 1, wherein each body further includes a third conductive portion configured as the antenna and a second dielectric slot configured between the third conductive portion and the second conductive portion.

11. The device of claim 1, wherein a width of the dielectric slot of each of the first and second bodies is substantially smaller than a width of the first conductive portion.

12. The device of claim 1, wherein the first conductive portion of the first and second bodies are configured as multiple antennas of the device and does not detune antenna operation when the bodies are on one another, and the first conductive portions are configured for additional antenna diversity when the bodies are separated.

13. The device of claim 1, wherein the first and the second conductive portions comprise metal.

14. The device of claim 1, wherein the dielectric slot of the first and second bodies is configured as one of the following: horizontal, vertical, a freeform line, an oblique line, branching, and dual slots.

15. The device of claim 1, wherein an edge of the first conductive portion of the first body and an edge of the first conductive portion of the second body are located at a distance from each other.

16. The device of claim 15, wherein the distance is larger when the device is in an unfolded position than when the device is in a folded position, and in the unfolded position, the first and second conductive portions are located away from one or more user effects, including hand absorption.

17. A mobile device, comprising:

a first body and a second body, wherein the bodies are configured to be displaceable with respect to each other when using the mobile device, wherein each body comprises:

a first conductive portion of a cover of the mobile device configured as an antenna of the device;

a second conductive portion of the cover configured as a ground of the antenna; and a dielectric slot in the cover, which is configured between the first and the second conductive portions, the dielectric slot extending across an entire length of a face of the cover of the first and second bodies, respectively, from an edge to an opposite edge of the cover of the first and second bodies, and are configured to completely divide and electrically disconnect respective first and second conductive portions of each of the first and second bodies;

wherein a design of the first and the second conductive portion of the first body and the dielectric slot of the first body aligns identically with a design of the first and the second conductive portion of the second body and the dielectric slot of the second body when the bodies are on one another, the first and second conductive portions operable as antenna elements when the first and second bodies are on one another and when the first and second bodies are separated.

18. The mobile device of claim 17, wherein the first conductive portion of the second body is configured for antenna diversity for the antenna.

19. A method comprising:

attaching a first and a second body of a device to each other to a folded position so that a shape of a first and a second conductive portion of the first body and a dielectric slot of the first body aligns identically with a shape of a first and a second conductive portion of the second body and a dielectric slot of the second body, wherein the first body comprises:

the first conductive portion of a first cover of the device configured as an antenna of the device;

a second conductive portion of the first cover configured as a ground of the antenna; and a dielectric slot of the first cover, which is configured between the first and the second conductive portions;

wherein the second body comprises:

a first conductive portion of a second cover of the device;

a second conductive portion of the second cover; and a dielectric slot of the second cover, which is configured between the first and the second conductive portions, the dielectric slot of the cover and the second cover extending across an entire length of a face of the cover and the second cover, respectively, from an edge to an opposite edge of the cover and the second cover, and are configured to completely divide and electrically disconnect respective first and second conductive portions of each of the cover and the second cover; and maintaining an attachment, when the device is unfolded to an unfold position, so that the first conductive portion of the first body and the first conductive portion of the second body are at a distance from each other, the first and second conductive portions operable as antenna elements when the first and second bodies are on one another and when the first and second bodies are separated.

20. The method of claim 19, wherein the first conductive portion of the first body and the first conductive portion of the second body are configured for additional antenna diversity of the antenna.

* * * * *